US005283965A

United States Patent [19]

Clendenning

[11] Patent Number: 5,283,965

[45] Date of Patent: Feb. 8, 1994

[54] ATTACHMENT ASSEMBLY FOR EXCAVATION TEETH

[75] Inventor: Charles Clendenning, Broken Arrow, Okla.

[73] Assignee: H & L Tooth Company, Montebello, Calif.

[21] Appl. No.: 789,098

[22] Filed: Jan. 21, 1992

[51] Int. Cl.[5] ..... E02F 9/28

[52] U.S. Cl. ..... 37/455; 37/454

[58] Field of Search ..... 37/141 T, 141 R, 142 R, 37/142 A, 118 R, 103, 115

[56] References Cited

U.S. PATENT DOCUMENTS

| | | | |
|---|---|---|---|
| 4,570,365 | 2/1986 | Bierwith | 37/141 T |
| 4,932,145 | 6/1990 | Reeves, Jr. | 37/141 T |

FOREIGN PATENT DOCUMENTS

| | | | |
|---|---|---|---|
| 2744497 | 4/1979 | Fed. Rep. of Germany | 37/141 T |
| 2253883 | 7/1975 | France | 37/141 T |
| 682605 | 8/1979 | U.S.S.R. | 37/141 T |

*Primary Examiner*—Dennis L. Taylor
*Assistant Examiner*—J. Russell McBee
*Attorney, Agent, or Firm*—Lyon & Lyon

[57] ABSTRACT

An attachment assembly for securing excavation teeth to the loading or dipper bucket on large excavation equipment. The assembly includes a bucket lip adapted to be secured to a loading or dipper bucket, and a plurality of shanks adapted to be secured to the lip and carry the excavation teeth. The lip defines a forward edge extending transversely thereacross and defining a plurality of spaced first curvilinear bearing surfaces. Each of the shanks carried by the bucket lip defines a lateral channel therein adapted to receive a portion of the bucket lip and terminating in a second curvilinear bearing surface. The second curvilinear bearing surface abuts and mates with one of the first curvilinear bearing surfaces on the bucket lip upon shank being disposed thereover. The first and second curvilinear bearing surfaces define equal radius segments of a constant radius circle such that the shank can be aligned parallel to at an angle at up to fifteen degrees with respect to the central longitudinal axis of the bucket lip with the abutting and mating relationships of the first and second bearing surfaces being maintained so as to prevent bearing fracture within the shank during use. The mating relationships of the bearing surfaces defined by the bucket lip and shanks obviate the need to provide differently configured shanks for left, right and central mounting on bucket lips provided with conventional arcuate or spade-shaped forward edges and additionally allows the outer most shanks to be angled outwardly from the central axis of the lip to provide a digging clearance for the bucket.

21 Claims, 2 Drawing Sheets

ATTACHMENT ASSEMBLY FOR EXCAVATION TEETH

BACKGROUND OF THE INVENTION

The present invention relates generally to an attachment assembly for connecting large excavation teeth to the loading or dipper bucket of large earth excavation equipment. Tooth attachment assemblies for large excavation equipment, typically include a number of large shanks which are spaced along and secured to the forward lip of the shovel dipper or loader bucket such that they project forwardly therefrom. A digging tooth or tooth point fits over the projecting end of each of the shanks and is secured thereto by an attachment pin.

For years, the lips of these large loader and dipper buckets comprised massive metal castings, often a foot thick, which were welded onto the bucket. Because these lips were cast, the massive size was necessary to provide the bucket lip with sufficient strength and durability to withstand the stress of large scale earth excavation. The forward edges of these bucket lips on which the shanks were mounted were not always straight, but often convexly curved or spade-shaped, as many people felt that these configurations provided superior digging characteristics. The teeth, however, must be in parallel axial alignment with the central axes of the bucket and bucket lip. To align the tooth-carrying shanks on these lips, the forward edges of the lips were formed with a plurality of projecting alignment horns which would engage the interior of the shanks and provide the desired parallel axial alignment of the shanks and the excavation teeth secured thereto. To enable earth to pass more readily over the thick blunt portions of the lips between the shanks and teeth, the forward edge of the lips were beveled. Lip protectors somewhat similar in configuration to the tooth carrying shanks, albeit smaller, were secured to the lips between the shanks to prevent damage to the forward tapered edge of the lip during earth excavation. On those bucket lips having curved or spade-shaped forward edges, these lip protectors were differently configured depending upon whether they were to be mounted on the right side, left side or in the center of the lip to obtain proper alignment of the lip protectors. Accordingly, it was necessary to provide three different configurations of lip protectors.

Because of the size and weight of these large cast bucket lips, the carrying capacity of the buckets was reduced. To decrease the weight of the lip and thereby increase the carrying capacity of the bucket, considerably thinner bucket lips were developed which were formed from thin plates of high strength alloy steel. Because these thinner plates could not be provided with integral alignment horns, it became necessary to employ three different configurations of shanks as well as lip protectors for use on the right, left and center portions of these preferred lighter weight lips employed convex or spade-shaped forward edges. In addition, without the benefit of the alignment horns which also prevented lateral movement of the shanks, the shanks had to be welded onto the lip which made shank replacement a difficult, timely and expensive process. As a result, the industry sought an attachment assembly which employed these thinner and lighter steel plate bucket lips to retain the increased carrying capacity resulting therefrom, but which could carry the tooth point mounting shanks without the need for welding to reduce the costs of shank replacement. The attachment assembly of the present invention not only satisfies this need but also obviates the need for differently configured shanks and lip protectors on bucket lips having convex or spade-shaped forward edges. The attachment assembly of the present invention, while primarily intended for use on large earth excavation equipment, is also adaptable for use on smaller excavation equipment as well.

SUMMARY OF THE INVENTION

Briefly, the present invention is directed to an improved attachment assembly for securing large excavating teeth on the loading or dipper bucket of large earth excavation equipment. The assembly comprises a flat bucket lip constructed of high strength alloy steel which is adapted to be welded onto a loading or dipper bucket, and a plurality of identically configured tooth point attachment shanks which are adapted to be secured to and along the lip in a mating contact therewith. The mating engagement of the shanks and lip allows the lip to be provided with a straight, convex or spade-shaped forward edge, as desired, and the shanks to be secured in parallel and axial alignment with the bucket and bucket lip regardless of whether the shank is positioned on the right, left or center portion of the lip.

The forward edge of the bucket lip of the present invention defines a plurality of spaced curvilinear bearing surfaces therein. The shanks each define a base portion and a tapered nose portion. The base portion is bifurcated and is adapted to extend about a portion of the lip and one of the bearing surfaces therein. The tapered nose portion projects from the base portion for the mounting of the tooth point thereon. The bifurcated base portion of the shank defines an open ended channel for receiving the lip which terminates in a curvilinear bearing surface for abutting mating contact with any one of the bearing surfaces formed in the forward edge of the lip. The bearing surfaces in the lip and the shanks all define equal radius segments of a constant radius circle to allow for variations in the angular alignment of the shanks with respect to the lip while continually maintaining the mating contact between the bearing surfaces on the shanks and lip over substantially the entire lengths thereof. As a result, only a single shank configuration is required regardless of whether the shank is positioned on the right or left side or in the center of the lip. As a result of the support afforded by mating engagements between the forward edge of the bucket lip and the shanks, the shanks can be secured to the lip by releasable bolt or pin means whereby the shanks can be readily replaced when damaged or overly worn. Further, the same mating relationship can be provided for lip protectors disposed over the bearing surfaces in the lip between the shanks so as to provide the desired alignment of the lip protectors irrespective of their mounting location along the lip.

It is therefore the principal object of the present invention to provide relatively light weight attachment assembly for the connection of large excavation teeth to the loading or dipper bucket of large earth excavation equipment which obviates both the need to weld the shanks to the bucket lip and the need to provide multiple configurations of shanks and lip protectors for buckets having curved or spade-shaped forward edges.

It is another object of the present invention to provide an attachment assembly for securing large excavation teeth to the loading or dipper bucket of large earth excavation equipment which provides for improved bearing contact between the shank and dipper bucket lip to increase the life of the shank.

It is yet another object of the present invention to provide an attachment assembly for securing large excavation teeth to the loading or dipper bucket of large earth excavation equipment which allows the outer most mounted shanks to be angled outwardly with respect to the other shanks on the bucket lip to create a digging clearance for the sides of the dipper bucket without the need to provide differently configured shanks for such angular mountings.

These and other objects and advantages of the present invention will become readily apparent from the following detailed description taken in conjunction with the accompanying drawings.

DESCRIPTION OF THE PREFERRED EMBODIMENTS

Figure 1:
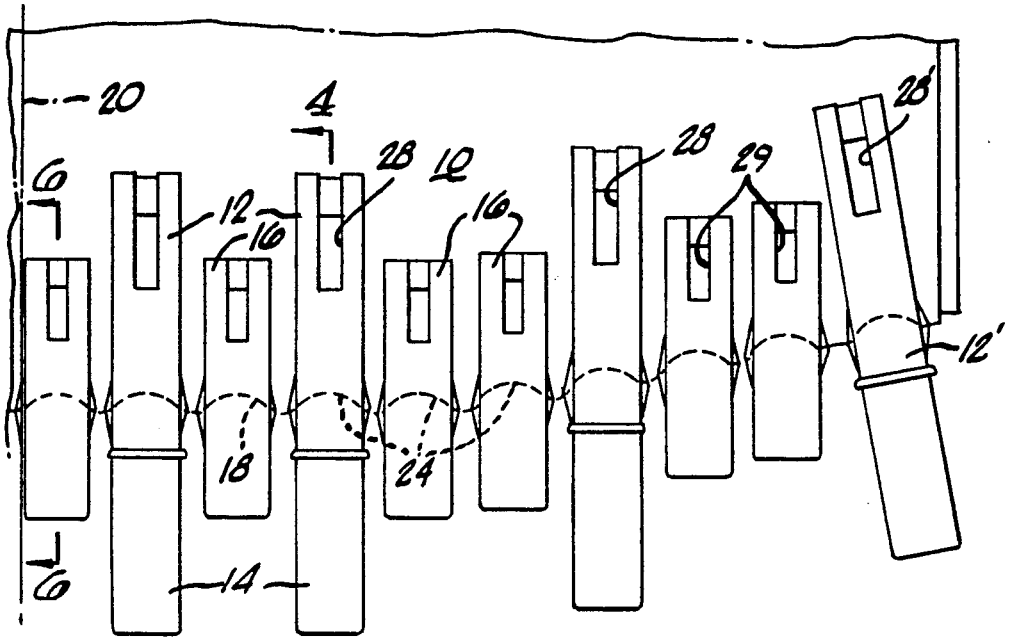
FIG. 1 is a plan view of the attachment assembly of the present invention.
Figure 2:
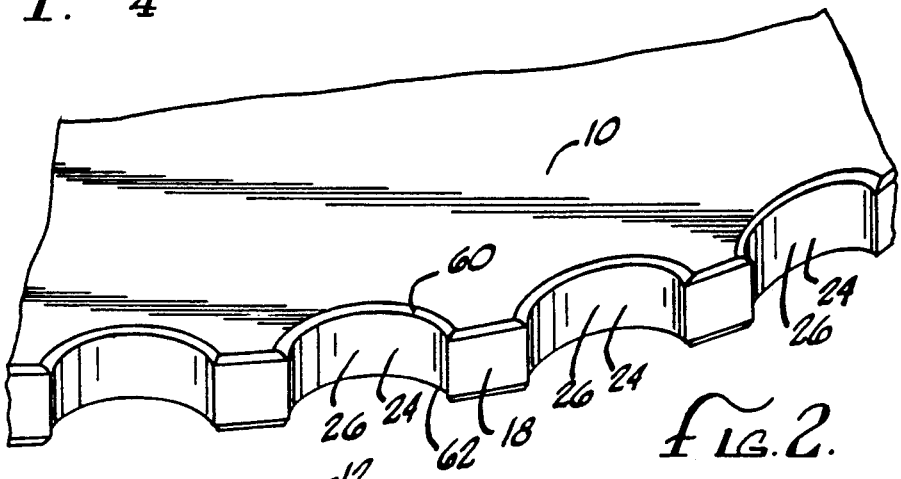
FIG. 2 is a partial perspective view of the dipper bucket lip of the present invention.
Figure 3:
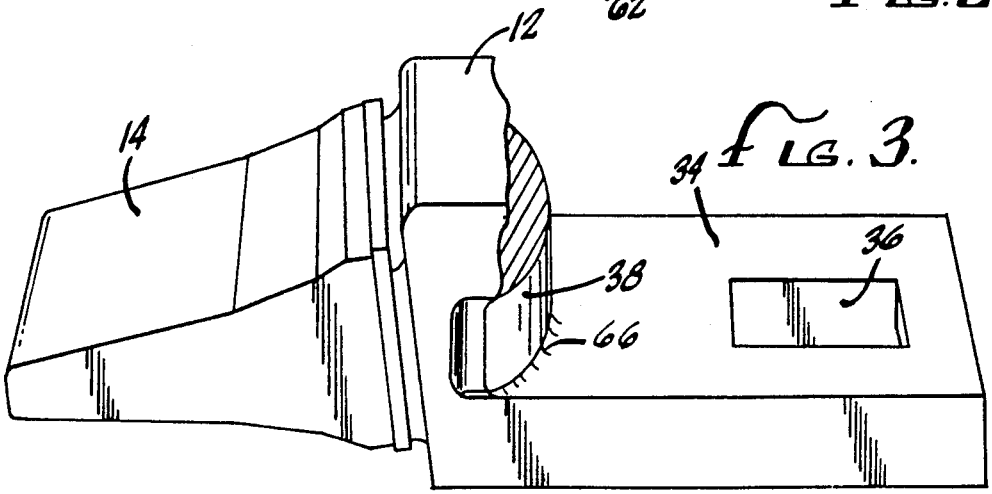
FIG. 3 is a perspective view of a shank of the present invention with an excavation tooth disposed thereon and a portion of the shank broken away to show the curvilinear bearing surface thereon.
Figure 4:
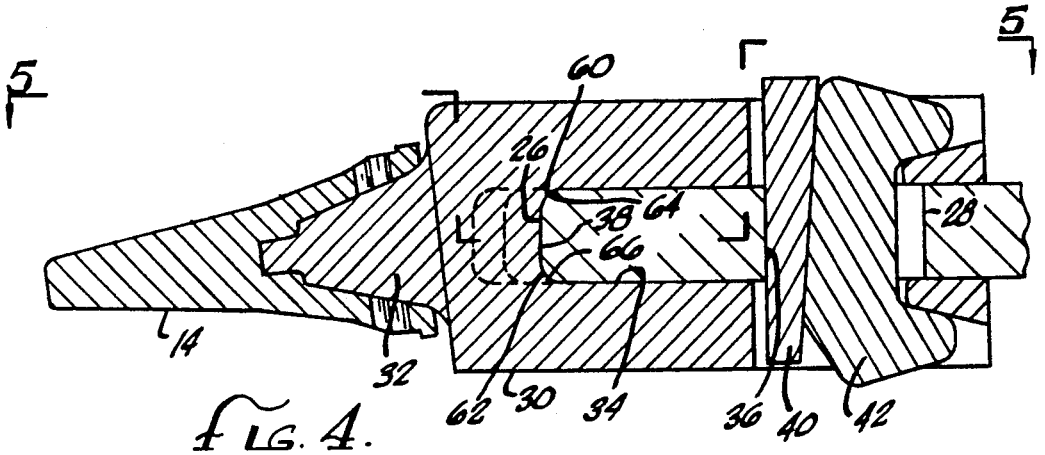
FIG. 4 is a sectional view taken along the line 4—4 in FIG. 1,.
Figure 5:
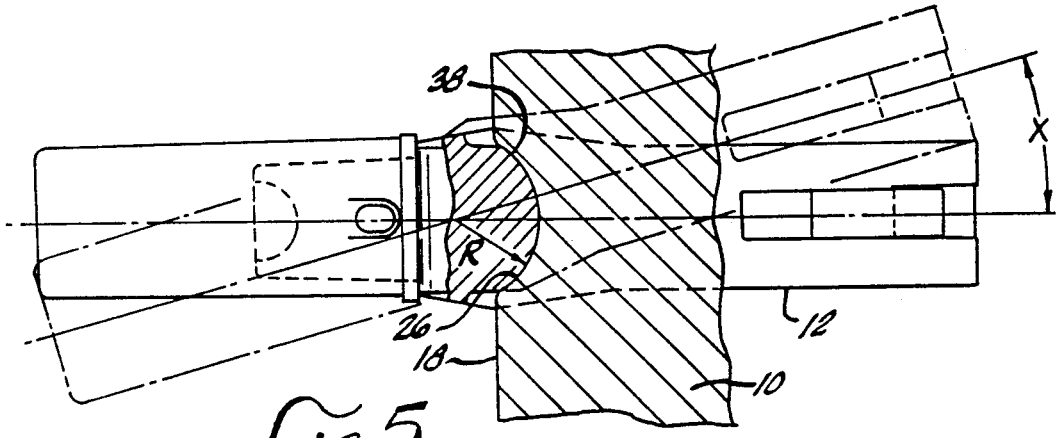
FIG. 5 is a sectional view taken along the line 5—5 in FIG. 4.

Referring now in detail to the drawings, the assembly of the present invention is comprised of a substantially flat bucket lip 10 which is adapted to be welded to the forward lower end portion of a conventional loading or dipper bucket (not shown), a plurality of shanks 12 which are carried by the bucket lip 10 and in turn carry the excavation teeth 14, and a plurality of lip protectors 16 disposed on lip 10 between shanks 12 for protecting the forward edge 18 of lip 10 during excavation.

The bucket lip 10 is preferably cut from a flat plate of high strength alloy steel of about two to five inches in thickness depending on the desired application. The forward transverse edge 18 of lip 10, as in conventional bucket lips, can be formed generally straight across, perpendicular to the central axis 20 of the lip and bucket, in a convex arcuate configuration or, as seen in the drawings, in a spade-shaped configuration. When employing a convex or spade-shaped forward edge, the degree of inclination is preferably between about ten to twelve degrees, as in the case with conventional bucket lips, but not more than fifteen degrees. The forward edge 18 of lip 10 has a plurality of spaced curvilinear recessed areas 24 cut therein defining a corresponding plurality of spaced curvilinear bearing surfaces 26 of equal and constant radius.

The shanks 12 are of single piece construction and each define a base portion 30 and tapered nose portion 32. Base portion 30 is bifurcated so as to create a transverse channel 34 extending laterally therethrough so that the shank can be slided onto the bucket lip over one of the recessed areas 24 and bearing surfaces 26 therein. Channel 34 terminates at its forward end in a bearing surface 38 having the same radius of curvature as the bearing surfaces 26 defined in the forward edge 18 of lip 10. Upon sliding shank 12 onto lip 10, bearing surface 38 abuts and mates with one of the bearing surfaces 26 in the forward edge 18 of lip 10 such that the angular orientation of the shank with respect to the lip could be varied and the mating contact between bearing surfaces 38 and 26 maintained throughout substantially the entire lengths thereof. This mating configuration allows the shanks to be aligned parallel to or at an angle of about fifteen degrees with respect to the central axis 20 of the lip and, when secured, provides sufficient support for the shanks to prevent bearing fracture within the shanks during use. As a result, the shanks 12 can be aligned parallel to axis 20 even though the forward edge 18 is convex or spade-shaped.

In the preferred embodiment of the present invention, the shanks 12 are secured to lip 10 by conventional locking wedges and clamps. Accordingly, a plurality of longitudinal slots 28 are disposed in lip 10 rearwardly spaced from those bearing surfaces 26 over which a shank 12 is to be mounted. Slots 28 are aligned with the intended central axis of the shank 12 to be mounted thereover which, except for the outermost shanks 12', is parallel to the central axis 20 of the lip 10. The outermost shank 12 may be angled outwardly to provide digging clearances for the side of the bucket and thus the corresponding outermost slots 28' would also be angled outwardly with respect to axis 20. A second plurality of longitudinal slots 29 is also provided in lip 10 rearwardly spaced from the remaining bearing surfaces over which the lip protectors 16 are to be secured. Slots 29 are preferably aligned parallel to axis 20 and positioned closer to forward edge 18 of lip 10 due to the lip protectors 16 being shorter than the shanks 12.

The base portions 30 of each of shanks 12 are also provided with a vertical slot 36 therein which is aligned with one of the slots 28 in lip 10 so that the shanks can be secured in place in their desired angular orientation by a conventional locking wedge 40 and clamp 42 which extend through the aligned slots 28 and 36. The teeth 14 are then secured to the nose position 32 of shanks 12 by conventional mounting pins.

Figure 6:
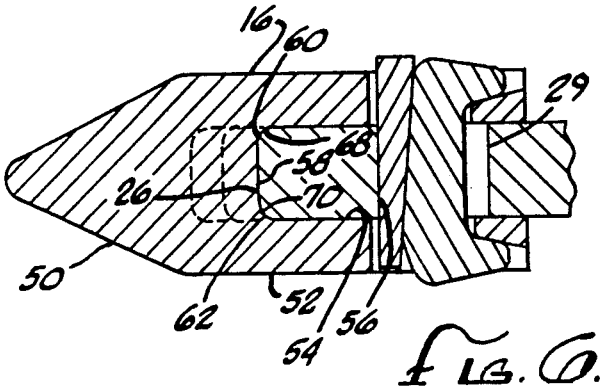
FIG. 6 is a sectional view taken along the line 6—6 in FIG. 1.

The lip protectors 16 are configured somewhat similar to the shanks 12, albeit considerably shorter and shallower as seen in FIG. 1. Lip protectors 16 are also of single piece construction and as seen in FIG. 6, define a tapered nose portion 50 and a bifurcated base portion 52 forming a transverse channel 54 therein. A vertical attachment slot 56 is also provided in base portion 52 for alignment with one of slots 29 and securement to the bucket lip 10 with clamps and wedges in the same manner as shanks 12. Channels 54, like channels 34 in shanks 12 each define a bearing surface 58 at the forward ends thereof, identical to the bearing surfaces 38 in shanks 12 whereby the same versatility in angular alignment is provided for the lip protectors 16 as with the shanks 12. Accordingly, the need for differently configured lip protectors for left, right and center mounting is similarly avoided.

To avoid the formation of any stress risers in the assembly of the present invention which could weaken the assembly, the areas 60 and 62 about bearing surfaces 26 in lip 10 are preferably chamfered to remove the sharp corners. The corresponding areas 64 and 66 in shanks 12 and 68 and 70 in lip protectors are provided with a reverse chamfer to mate with areas 60 and 62 on lip 10.

While the bearing surfaces 26 in lip 10 are formed by recessed areas 24 and are therefore concave and mate the convex bearing surfaces 38 of shanks 12, it is to be understood that the lip 10 could be provided with convex bearing surfaces which would then mate with concave bearing surfaces formed at the ends of the transverse channels 34 in the shanks. Regardless of which configuration is employed, the mating bearing surfaces in the shanks 12 and lip 10 each define equal radius segments of a constant radius circle to allow for the variable mounting of the shanks on the lip while providing the support necessary to prevent bearing fractures within the shanks. The actual radius can vary depending on the desired size of the shanks. Various other changes and modifications may be made in carrying out the present invention with departing from the spirit and scope thereof. Insofar as these changes and modifications are within the purview of the appended claims, they are to be considered as part of the present invention.

I claim:

1. An attachment assembly for securing excavation teeth to an excavation bucket on large excavation equipment, said assembly comprising:

a substantially flat bucket lip adapted to be secured to the excavation bucket, said lip defining a forward edge and a plurality of spaced-apart first curvilinear bearing surfaces disposed adjacent said edge;

a plurality of shanks adapted to be secured to be bucket lip about said forward edge thereof for carrying the excavation teeth, each of said shanks defining a lateral channel therein adapted to receive a portion of said lip, said channel terminating in a second curvilinear bearing surface adapted to abut and mate with one of said first curvilinear bearing surfaces in said lip upon said shank being disposed about said portion of said lip, whereby said shanks can be secured to said lip at varying lateral angular orientations with respect thereto and the abutting and mating relationships of said first and second curvilinear bearing surfaces maintained so as to prevent bearing fracture within said shank during use; and means for securing said shanks to said bucket lip at the desired angular orientations with respect thereto.

2. The assembly of claim 1 wherein said first curvilinear bearing surfaces are concave and said second curvilinear bearing surfaces are convex.

3. The assembly of claim 1 including a plurality of lip protectors, said lip protectors being adapted to be secured to said lip with said shanks and each of said protectors defining a lateral channel therein adapted to receive a portion of said lip, said channel terminating in a third curvilinear bearing surface adapted to abut and mate with one of said first bearing surfaces in said lip upon said protector being disposed about said portion of said lip, said first, second and third curvilinear bearing surfaces each defining equal radius segments of a constant radius circle.

4. The assembly of claim 1 wherein said bucket lip defines a central axis extending therethrough and said forward edge passes transversely through said axis and extends therefrom in paths defining angles within the range of 75 to 90 degrees with respect thereto, and wherein said shanks can be angularly disposed on said lip at lateral angles of up to fifteen degrees with respect to said central axis with said first and second bearing surfaces being in abutting and mating relationships, whereby said shanks can be disposed parallel to said axis on said lip to the right, left or on the center of said axis.

5. The assemblies of claims 1 or 4 wherein said securing means comprises a wedging member.

6. An attachment assembly for securing excavation teeth to an excavation bucket on large excavation equipment, said assembly comprising:

a substantially flat bucket lip adapted to be secured to the excavation bucket and defining a central axis extending therethrough, a forward edge passing transversely through said axis and extending therefrom in paths defining angles within the range of 75–90 degrees with respect thereto and a plurality of spaced-apart first curvilinear bearing surfaces disposed adjacent said edge;

a plurality of shanks adapted to be secured to said lip about said forward edge thereof for carrying the excavation teeth, each of said shanks defining a lateral channel therein adapted to receive a portion of said lip, said channel terminating in a second curvilinear baring surface, said second curvilinear bearing surface abutting and mating with one of said first curvilinear baering surfaces upon said shank being disposed about said portion of said lip, said first and second curvilinear bearing surfaces defining equal radius segments of a constant radius circle such that each of said shanks can be aligned parallel to and at lateral angles of up to about fifteen degrees with respect to said central axis of said lip to the right, left or on said axis and the abutting and mating relationships of first and second bearing surfaces maintained such that bearing fracture within said shank during use is prevented; and means for securing said shanks to said bucket lip at the desired angle orientations with respect to said central axis of said lip.

7. The assembly of claim 6 wherein said forward edge of said bucket lip is chamfered about said first bearing surfaces therein, and portions of said shanks proximate said second bearing surfaces therein are configured to abut and mate with the chambered forward edge of the lip to eliminate any stress risers between said lip and said shanks in said attachment assembly.

8. The attachment assembly of claim 7 including a plurality of lip protectors, said lip protectors being adapted to be secured to said lip between said shanks and each of said protectors defining a lateral channel therein adapted to receive a portion of said lip, said channel terminating in a third curvilinear bearing surface adapted to abut and mate with one of said first bearing surfaces in said lip upon said protector being disposed about said portion of said lip, said third curvilinear bearing surfaces each defining a radius of curvature equalled to the radius of curvature of said first and second bearing surfaces.

9. A shank for use in an attachment assembly for securing excavation teeth to the lip of an excavation bucket on large excavation equipment in which the lip defines a central axis and is provided with a plurality of spaced-apart curvilinear bearing surfaces of equal and constant radius adjacent the forward edge thereof, said shank comprising a base portion and a nose portion, said base portion having a lateral channel therein adapted to receive a portion of the bucket lip, said channel terminating in a curvilinear bearing surface adapted to abut and mate with one of the bearing surfaces in the bucket lip, said bearing surface in said shank defining a constant radius equal to the radius of the bearing surfaces in the bucket lip whereby the shank can be secured to the bucket lip over any of said plurality of bearing surfaces therein and aligned parallel to and at lateral angles of up to fifteen degrees with respect to the central axis of the lip and the abutting and mating relationship of the bearing surface defined by the shank and the bearing surface defined by the lip within the shank maintained so as to prevent bearing fracture within the shank during use.

10. A lip adapted to be secured to an excavation bucket on large excavation equipment for carrying a plurality of tooth carrying shanks thereon, said lip comprising a substantially flat member defining a central axis extending therethrough, a forward edge passing transversely through said axis and extending therefrom in paths defining angles within the range of 75–90 degrees with respect thereto and a plurality of spaced-apart curvilinear bearing surfaces adjacent said edge, each of said bearing surfaces being of equal and constant radius and adapted to abut and mate with a curvilinear bearing surface defined by one of the shanks whereby any one of the shanks can be secured to the bucket lip over any one of said bearing surfaces defined therein and aligned parallel to and at lateral angles of up to about 15 degrees with respect to the central axis of said lip and the abutting and mating relationships of said bearing surfaces in said edge and the bearing surfaces disposed within the shanks maintained so as to prevent bearing fracture within the shanks during use.

11. The lip of claim 10 wherein said forward edge thereof is chamfered about said bearing surfaces therein.

12. The lip of claims 10 or 11 wherein said forward edge is arcuate.

13. The lip of claims 10 or 11 wherein said forward edge is spade-shaped.

14. An attachment assembly for securing excavation teeth to an excavation bucket on large excavation equipment, said assembly comprising:

a substantially flat bucket lip adapted to be secured to the excavation bucket, said lip defining a central axis extending therethrough, a forward edge passing transversely through said axis and extending therefrom in paths defining angles within the range of 75–90 degrees with respect thereto, and a plurality of spaced-apart first curvilinear bearing surfaces adjacent said edge;

a plurality of shanks adapted to be secured to said lip about said forward edge thereof for carrying the excavation teeth, each of said shanks defining a lateral channel therein adapted to receive a portion of said lip, said channel terminating in a second curvilinear bearing surface, said second curvilinear bearing surface extending transversely across the width of said shank and abutting and mating with any one of said first curvilinear bearing surfaces upon said shank being disposed thereover such that said shank can be aligned parallel to and at lateral angles of up to about 15 degrees with respect to said central axis of said lip to the right, left or on said axis and the abutting and mating relationship of said first and second surfaces maintained such that bearing fracture within said shank during use is prevented; and means for securing said shanks to said bucket lip at the desired angular orientations with respect to said axis.

15. The attachment assembly of claim 14 including a plurality of substantially identical lip protectors, said lip protectors being adapted to be secured to said lip with said shanks and each of said protectors defining a lateral channel therein adapted to receive a portion of said lip, said channel terminating in a third curvilinear bearing surface adapted to abut and mate with any one of said first bearing surfaces in said lip upon said protector being disposed thereover such that said protectors can be aligned parallel to and at lateral angles of up to about 15 degrees with respect to said central axis of said lip to the right, left or on said axis and the abutting and mating relationship of said first and third bearing surfaces maintained such that bearing fracture within said protectors during use is prevented.

16. A lip protector for use with an attachment assembly for securing excavation teeth to the lip of an excavation bucket on large excavation equipment in which the dip defines a central axis and is provided with a plurality of spaced-apart curvilinear bearing surfaces of equal and constant radius adjacent the forward edge thereof, said lip protector comprising a base portion and a nose portion, said base portion having a lateral channel therein adapted to receive a portion of the bucket lip, said channel terminating in a curvilinear bearing surface extending transversely across the width of said protector and being adapted to abut and mate with one of the bearing surfaces in the bucket lip, said bearing surface in said lip protector defining a constant radius equal to the radius of the bearing surfaces in the bucket lip whereby the lip protector can be secured to the bucket lip over any said plurality of bearing surfaces therein and aligned parallel to and at lateral angles of up to fifteen degrees with respect to the central axis of the lip and the abutting and mating relationship of the bearing surface defined by the lip protector and the bearing surface defined by the lip disposed within said lip protector maintained so as to prevent bearing fracture within said lip protector during use.

17. A shank adapted for securement to a lip of an excavation bucket on earth excavation equipment wherein the lip defines a central axis and is provided with a plurality of spaced-apart curvilinear bearing surfaces defining constant and equal radii of curvature adjacent the forward edge thereof, said shank comprising:

a nose portion adapted to carry an excavation tooth thereon; and a base portion having a lateral channel defined therein adapted to receive a portion of the bucket lip and terminating in a curvilinear bearing surface defining a radius of curvature equal to the radius of curvature defined by the bearing surfaces in the lip so as to abut and mate with any one of the bearing surfaces in said lip upon said base portion being disposed thereover, whereby said shank can be secured to the bucket lip in a mating engagement with any one of the bearing surfaces therein and aligned parallel to and at a lateral angular disposition with respect to said axis.

18. A lip protector adapted for securement to a lip of an excavation bucket on earth excavation equipment wherein the lip defines a central axis and is provided with a plurality of spaced-apart curvilinear bearing surfaces defining constant and equal radii of curvature adjacent the forward edge thereof, said lip protector comprising:

a nose portion having a tapered forward end; and a base portion having a lateral channel defined therein adapted to receive a portion of the bucket lip and terminating in a curvilinear bearing surface defining a radius of curvature equal to the radius of curvature defined by the bearing surfaces in the lip so as to abut and mate with any one of the bearing surfaces in said lip upon said base portion being disposed thereover, whereby said lip protector can be secured to the bucket lip in a mating engagement with any one of the bearing surfaces therein and aligned parallel to and at a lateral angular disposition with respect to said axis.

19. The shank of claim 17 wherein said bearing surface in said shank extends transversely across the width of the base portion of said shank.

20. The lip protector of claim 18 wherein said bearing surfaces in said protector extends transversely across the width of the base portion of said protector.

21. An attachment assembly for securing excavation teeth to the excavation bucket on large excavation equipment, said assembly comprising:

a substantially flat bucket lip adapted to be secured to the excavation bucket, said lip defining a forward edge and a plurality of spaced-apart first curvilinear bearing surfaces in said edge, said surfaces each defining equal radius segments of a constant radius circle;

a plurality of shanks adapted to be secured to the bucket lip about said forward edge thereof, each of said shanks defining a second curvilinear bearing surface thereon and each of said second curvilinear bearing surfaces defining a radius of curvature equal to the radius of curvature defined by said first curvilinar bearing surfaces so as to abut and mate with any one of said first curvilinear bearing surfaces in said lip upon said shank being disposed thereagainst whereby said shanks can be secured to said lip at varying lateral angular orientations with respect thereto and the abutting and mating relationships of said first and second curvilinear bearing surfaces maintained so as to prevent bearing fracture within said shanks during use; and means for securing said shanks to said bucket lip at the desired angular orientations with respect thereto.

* * * * *